US005501442A

United States Patent [19]

Mandel

[11] Patent Number: 5,501,442

[45] Date of Patent: Mar. 26, 1996

[54] DUAL MODE TAMPER/OFFSETTER

[75] Inventor: Barry P. Mandel, Fairport, N.Y.

[73] Assignee: Xerox Corporation, Stamford, Conn.

[21] Appl. No.: 270,350

[22] Filed: Jul. 5, 1994

Related U.S. Application Data

[63] Continuation-in-part of Ser. No. 148,454, Nov. 8, 1993, Pat. No. 5,377,965.

[51] Int. Cl.[6] ..... B65H 31/34

[52] U.S. Cl. ..... 270/58; 414/907

[58] Field of Search ..... 270/58, 54, 37, 270/53, 45, 51; 271/221, 238, 240; 355/322, 324; 414/907, 789.1, 791.2

[56] References Cited

U.S. PATENT DOCUMENTS

| | | | |
|---|---|---|---|
| 4,073,391 | 2/1978 | O'Brien et al. | 271/221 X |
| 4,134,672 | 1/1979 | Burlew et al. | 270/58 X |
| 4,712,786 | 12/1987 | Looney | 271/207 |
| 4,828,247 | 5/1989 | Matsuo et al. | 271/240 |
| 5,007,625 | 4/1991 | Kremers et al. | 270/58 X |
| 5,188,353 | 2/1993 | Parks | 271/221 X |
| 5,385,340 | 1/1995 | Hiroi et al. | 270/53 |

FOREIGN PATENT DOCUMENTS

| | | | |
|---|---|---|---|
| 143853 | 8/1984 | Japan | 271/221 |
| 41130 | 2/1987 | Japan | 271/221 |

*Primary Examiner*—John E. Ryznic

[57] ABSTRACT

In a sheet stacking and job separating system for a reproduction apparatus, in which, repeatedly, plural printed sheets are compiled as a print job set by being tamped into a squared stack in a compiler with a tamper system, and the compiled stack is ejected from the compiler onto an output stacking tray holding plural stacks in a common stack, and wherein respective print job stacks are stacked offset from one another in the output tray: a dual mode print job set stack tamper and job sets offsetting system in a first mode tamps the print job set in the compiler while retaining a defined stacking position, and in a second mode shifts selected print job sets out of the defined stacking position into an offset position to provide the offset in the output tray, preferably by moving both of the tampers in the same direction with the same drive motor.

1 Claim, 17 Drawing Sheets

DUAL MODE TAMPER/OFFSETTER

Cross-reference is made to a commonly owned copending application Ser. No. 08/113,662, filed Sep. 23, 1994, by Frederick A. Green, entitled "Dual Mode Set Stacking Tamper and Sheet Feeder Offset System", attorney docket No. D/94/126.

This is a continuation in part of U.S. application Ser. No. 08/148,454 filed Nov. 8, 1993, now U.S. Pat. No. 5,377,965, by one of the same inventors and the same assignee, which is incorporated by reference herein, and the priority benefit of which is claimed.

By way of background, a stack edge "tamper" system normally repeatedly reversibly moves one or more generally vertical tamper arms or walls against one or both sides of a set of sheets being compiled in the compiler or other tray, as the individual sheets enter the tray to stack therein. The tamper system normally must also reset, adjust or otherwise allow for different size sheets being stacked. Another name for a tamper is a "jogger", although the latter term can encompass different stacking assistance devices, such as top sheet feeder/flappers, and the like. Tamping causes the stack of sheets to stack squarely superposed in a single regular stack in a single defined or registration position.

The term "offsetting" generally relates to a different function. With regard to stacking, it refers to deliberate irregular stacking of plural job sets so that each separate job set is slightly laterally offset from adjacent job sets. That is, with a edge of one job set extending out by one or more centimeters over the same edge of the underlying set from which it is desired to be distinguished, or vice versa, etc. (However, each offset job set itself normally comprises squarely stacked plural sheets.)

Offsetting output jobs has several known advantages. The job sets are much more easily distinguished from one another and separated, especially unbound sets. As for stapled sets (or other bound sets), stacking stapled sets with the staples directly on top of one another (without offsetting) can undesirably result in what is called staple build up, which can limit total stapled set capacity in the stacking tray, and cause other problems, because the stack height increases in that area of the staples and becomes uneven.

Heretofore, these different tamping and offsetting functions were done in an unrelated manner by different systems and mechanisms. With the present dual mode system, their hardware, and especially the tamper drive system, can be shared for cost savings. The disclosed dual mode tamping system can provide stack tamping in a first mode, and stack offsetting in a second mode. The dual mode system disclosed in the embodiments herein provides both tamping and offsetting with the same or a partially shared system. The offsetting may be to provide offset stacking, as discussed, and/or offsetting of the stack for stapling, as by lateral movement of the compiled set into a stapler by the dual mode tamper system operating in its second or offsetting mode.

A specific feature of the disclosed embodiment is to provide a sheet stacking and job separating system for the printed sheet output of print jobs of a reproduction apparatus, in which, repeatedly, plural said printed sheets are compiled as a print job set by being tamped into a squared stack in a compiler with a tamper system, and said compiled print job set stack is ejected from said compiler onto an output stacking tray holding plural said print job set stacks in a common stack, and wherein respective said print job set stacks are stacked offset from one another in said output stacking tray: the improvement comprising a dual mode print job set stack tamper and job sets offsetting system, wherein in a first mode, said tamper system tamps said print job set into a squared stack in said compiler while retaining said print job set in a defined stacking position; and wherein in a second mode said tamper system shifts a selected said print job set out of said defined stacking position into an offset position to provide said offset position of said print job set in said output stacking tray.

Other disclosed features include, individually or in combination, those wherein said tamper system includes a spaced pair of upstanding sheet tampers between which said printed sheets are compiled, and a dual mode tamper drive system, and wherein in said first mode at least one of said tampers is driven towards the other said tamper to tamp said print job set into a squared stack in said defined stacking position by said dual mode tamper drive system, and wherein in said second mode said dual mode tamper drive system causes said tampers to move cooperatively to shift said print job set out of said defined stacking position into said print job set offset position; and wherein in said second mode said dual mode tamper drive system is connected to both said tampers to move both said tampers in the same direction by a selected print job set offsetting distance; and/or wherein said dual mode tamper drive system has a single drive motor which is differently connected to said tampers in said first mode than said second mode; and/or wherein a print job set transport transports said offset print job set from said compiler to said output stacking tray without changing said offset; and/or further including a stapling system for stapling a print job set therein, and wherein in said second mode said print job set is offset into said stapling system; and/or a method of sheet stacking and job separating in which repeatedly the printed sheet output of print jobs of a reproduction apparatus are compiled as a plural sheet print job set in a compiler and tamped into a squared stack with a tamper system, and said compiled print job set stack is ejected from said compiler onto an output stacking tray holding plural said print job set stacks in a common stack with respective said print job set stacks stacked offset from one another in said output stacking tray: the improvement wherein in a first mode the tamper system tamps the print job set into a squared stack in the compiler while retaining said print job set in a defined stacking position; and wherein in a second mode the tamper system shifts selected print job sets out of said defined stacking position into the desired offset position of said print job set in said output stacking tray, and said selected offset print job set is then ejected from said compiler onto said output stacking tray while maintaining said offset, to provide said offset position of said print job set in said output stacking tray relative to other print job sets in said output stacking tray.

Further by way of background, some examples of patents relating to single set edge tamping include U.S. Pat. Nos. 5,044,625; 5,288,062; 5,188,353; 5,044,625 (D/87242); 3,860,127; 4,134,672; 4,477,218; 4,480,825; 4,616,821; 4,925,172; 4,925,171 (D/87219); 5,098,074 (D/88157); and 5,044,625 (D/87242); and art cited therein. As noted in some of these tamping system patents, in in-bin sorter stapling systems, the tamper provides what may be called offsetting of the single set into a stapler, but that is single, stapling position, stacking registration, not the type of variable or plural position offset stacking discussed above.

Some examples of patents relating to offsetting of plural job set stacks from one another in an output stack include U.S. Pat. Nos. 4,480,825 and 4,712,786 with axial roller lateral sheet shifting, and other offsetting systems such as U.S. Pat. Nos. 4,157,059; 4,188,025; 4,318,539; 4,858,909; 4,861,213; 5,007,625; 5,037,081; and Japanese published application No. 3-267266 published Nov. 28, 1991. Further in regard to job offsetting, automatically stacking more than one unstapled copy set into sorter bins, with set offsetting, by bin side-shifting for increased bin capacity, is described in a Xerox Disclosure Journal publication Vol. 14, No. 1, January/February 1989, p. 29; and U.S. Pat. No. 4,688,924. The latter and U.S. Pat. No. 5,128,762 teach process-direction set offsetting. That is, individual job sets partial offsetting in the rearward or process (input) direction from other otherwise commonly stacked job sets As disclosed in this and other prior art, it is known that offsetting can be done by lateral or process direction incremental shifting or partial rotation of the output stacking tray, or reciprocal lateral shifting of individual sheets being outputted, as by axial shifting of the output or ejecting rollers.

By way of further background, compiler/stapler units with means for registration of one set at a time for stapling or other finishing, and then ejection of each set onto a stacking tray, preferably an elevator tray, are also well known, and some additional examples include those disclosed in Xerox Corporation U.S. Pat. Nos. 5,098,074; 5,288,062; 5,303,017 and 5,308,058; and also U.S. Pat. No. 5,137,265.

One embodiment of the subject dual mode tamper/offsetting system is disclosed is a simpler and lower cost and improved system for "on-line finishing" of folded booklets, i.e., simplified signatures finishing system providing center-folded and fastened booklets of signature collated pages outputted by an electronic printer, or other reproduction apparatus. This disclosed system provides improved sheet folding or creasing of each signature sheet in a finished booklet, for flatter, better stacking, and more professionally appearing finished booklets.

The disclosed signatures system can provide lower cost "on-line finishing" of properly folded booklets, with reduced component parts and/or overall size of the apparatus. In particular, there is disclosed in the embodiment herein a multimode, shared functions, folding and feeding rollers system, and also its integration with a simple "roof" or "saddle" type folded set compiler/stapler. With this disclosed system, the same roller set can be utilized for positively individually center creasing each signature sheet sequentially, and also for ejecting or feeding out each bound set of multiple signatures. The disclosed system can sharply crease and fold large signature sheets presented short edge first, desirably allowing a narrower processor without requiring sheet rotation or an "L" shaped path. The disclosed module accepts such printed output directly and linearly.

Further by way of background, especially as copiers and printers increase in speed and capabilities, it it is desirable for their paper handling and output to be more automated and made more reliable in general. "On-line finishing" is one means for such improvements. It may be roughly defined as a system in which the document pages being copied are printed in a order such that each copy set or job set comes out precollated, and thus can be automatically finished (stapled, glued or otherwise bound) in collated sets without manual handling or post-collation, starting immediately with the first set, and while subsequent copy sets of that same job are being printed by that reproduction apparatus. Preferably the finisher is integral, or a separable module at the output of, the reproduction apparatus for directly sequentially receiving the individual sheets as soon as they are printed.

Signature finishers have been provided for and used with the Xerox Corporation "DocuTech" electronic printer and other electronic printer products for on-line booklet finishing. Some recent Xerox patents include U.S. Pat. Nos. 5,159,395 and 5,184,185, Cols. 13–16 and FIG. 9. Many of these compile the copy sets flat, and fold the set only after the entire set is compiled.

Xerox Corporation patents on the general subject of generating collated signatures at a copier output include, e.g., U.S. Pat. Nos. 4,727,402 (D/82102) issued to R. E. Smith Feb. 23, 1988; 4,925,176 (D/88275) issued May 15, 1990 to T. Acquaviva (see Cols. 3–4); 4,814,822 (D/82077); and 5,241,474; and other art Also noted re signatures copying or printing are U.S. Pat. Nos. 4,727,402; 5,108,081; 5,080,340; 4,988,029; 4,891,681; 5,161,724; 4,595,187; and 4,592,651.

For the typical large, e.g., 11 by 17 size sheets printed as signatures, a sheet rotator may be provided upstream of the signature finisher. E.g., U.S. Pat. No. 5,090,638.

The present system may, of course, be optionally combined or provided with an orbiting nip or other optional sheet output inverter and/or plural mode or other alternative outputs for unbound sheets, etc., as disclosed in U.S. Pat. No. 5,201,517.

It is also additionally noted that combined facsimile and/or digital scanning, copying and printing (and even optional conventional light lens or digital direct copying) can be provided in a known manner in an integral or multifunctional unit which may also be encompassed by the term "printer" as used herein.

The job set printing, finishing, and or other instructions and controls can be provided locally on the printer and/or the subject signature finishing module, or remotely.

The disclosed apparatus may be readily operated and controlled in a conventional manner with conventional control systems, such as the above and other existing ones in printers, copiers, and their controllers, e.g., U.S. Pat. No. 4,475,156 and art cited therein. It is well known in general and preferable to program and execute such control functions and logic with conventionally written software instructions for conventional microprocessors. This is taught by various patents and commercial printers. Such software may of course vary depending on the particular function and the particular software system and the particular microprocessor or microcomputer being utilized, but will be available to or readily programmable by those skilled in the applicable arts without undue experimentation from either verbal functional descriptions, and/or drawings, such as those provided herein, together with general knowledge in the software and computer arts. Controls may alternatively be provided utilizing various other known or suitable hard-wired logic or switching systems.

As to other specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of this embodiment thereof, including the drawing figures wherein:

The disclosed dual mode system for both tamping and offsetting sets is not limited to signatures (book) printing systems. As particularly shown in FIGS. 14 and 17–18 and described further herein, the present system can be particularly utilized for any center registered compiling system, with two tampers or sets of tampers, respectively on opposite sides of the job stack being compiled. For tamping the tampers may be driven by the same tamper drive system towards and away from one another for square stacking of a job set in one stacking position. For offsetting, both tampers are driven in the same direction by the desired set offsetting distance. As disclosed herein, this may be accomplished with a dual mode tamper drive system. E.g., changing of the drive connection to at least one of the tampers on one side of the stack after the stack is compiled can provide lateral shifting of the entire compiled stack. By also providing a system for ejecting the entire compiled stack onto a stacking tray without losing lateral registration, as disclosed, offsetting of alternate or selected sets ejected from a normal complier can be provided in the compiler, before the set is ejected (stapled or unstapled) into the stacking tray or bin. This disclosed system thus does not require axially shifting the output rollers or shifting the stacking tray in order to provide sets offsetting. Alternatively, the present dual mode system can also be used for a front or rear registered (side registered) paper path, with a single tamper tamping sheets on one side of the stack towards a fixed registration wall on the other side of the stack. In that case, the dual mode tamper mechanism can be connected in its second mode to laterally shift the compiler side registration wall, or to laterally shift vertical fingers normally flush with that side registration wall, to shift a stapled set selected for offsetting laterally in the compiler before it is ejected. The tamper can also be moved to a non-tamping position after normal tamping is completed, if desired.

Figure 1:
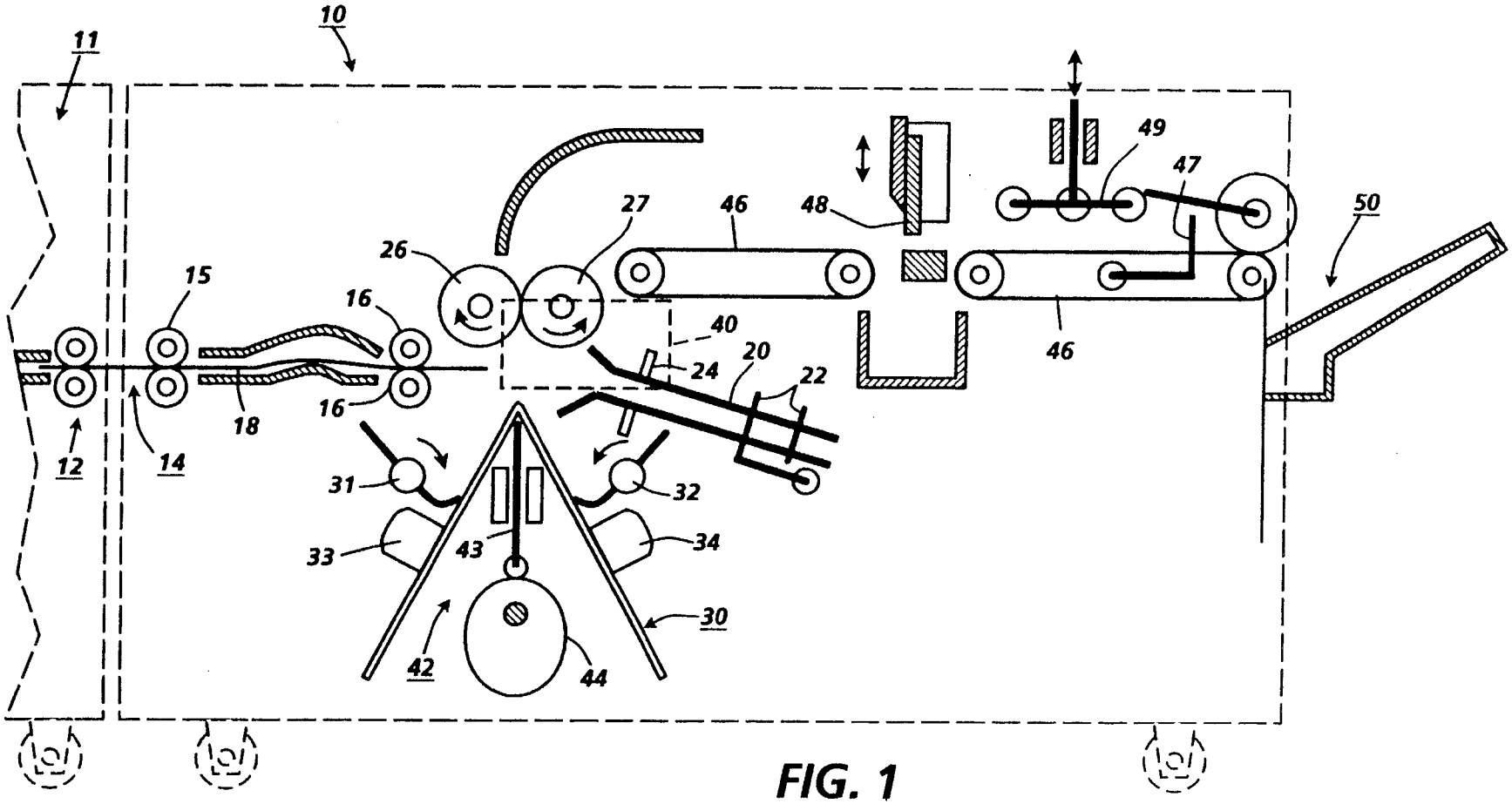
FIG. 1 is a schematic frontal view of one exemplary signatures finisher module, incorporating one example of the dual mode tamper/offsetting compiler of this invention, with a sequential sheet full folder, sheets compiler, stapler and job set ejector, in one integral unit, also showing schematically one example of the output end of an operatively connecting electronic printer.
Figure 2:
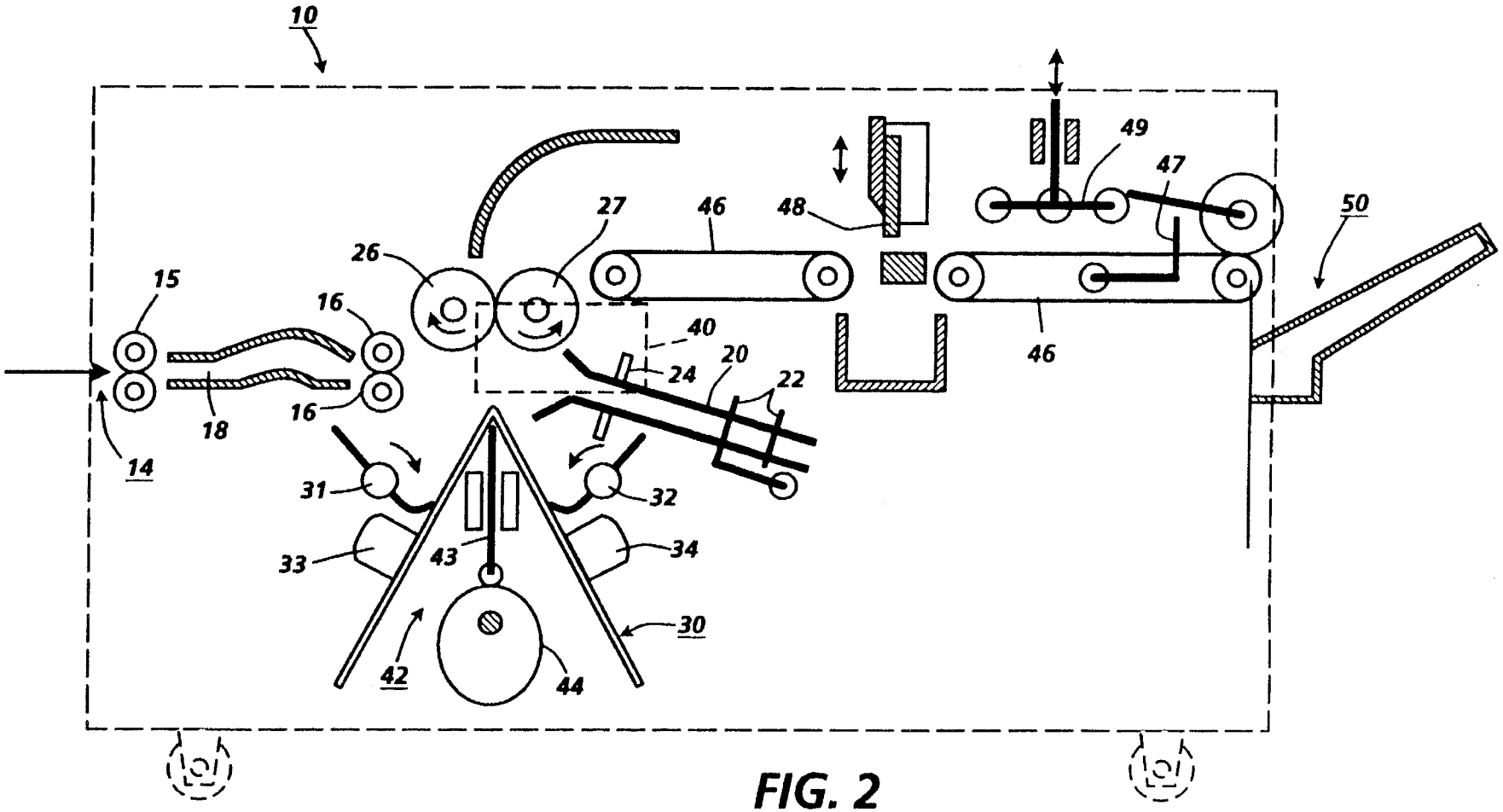
FIG. 2 is a more detailed internal schematic frontal view of the exemplary signature finishing system of FIG. 1.
Figure 3:
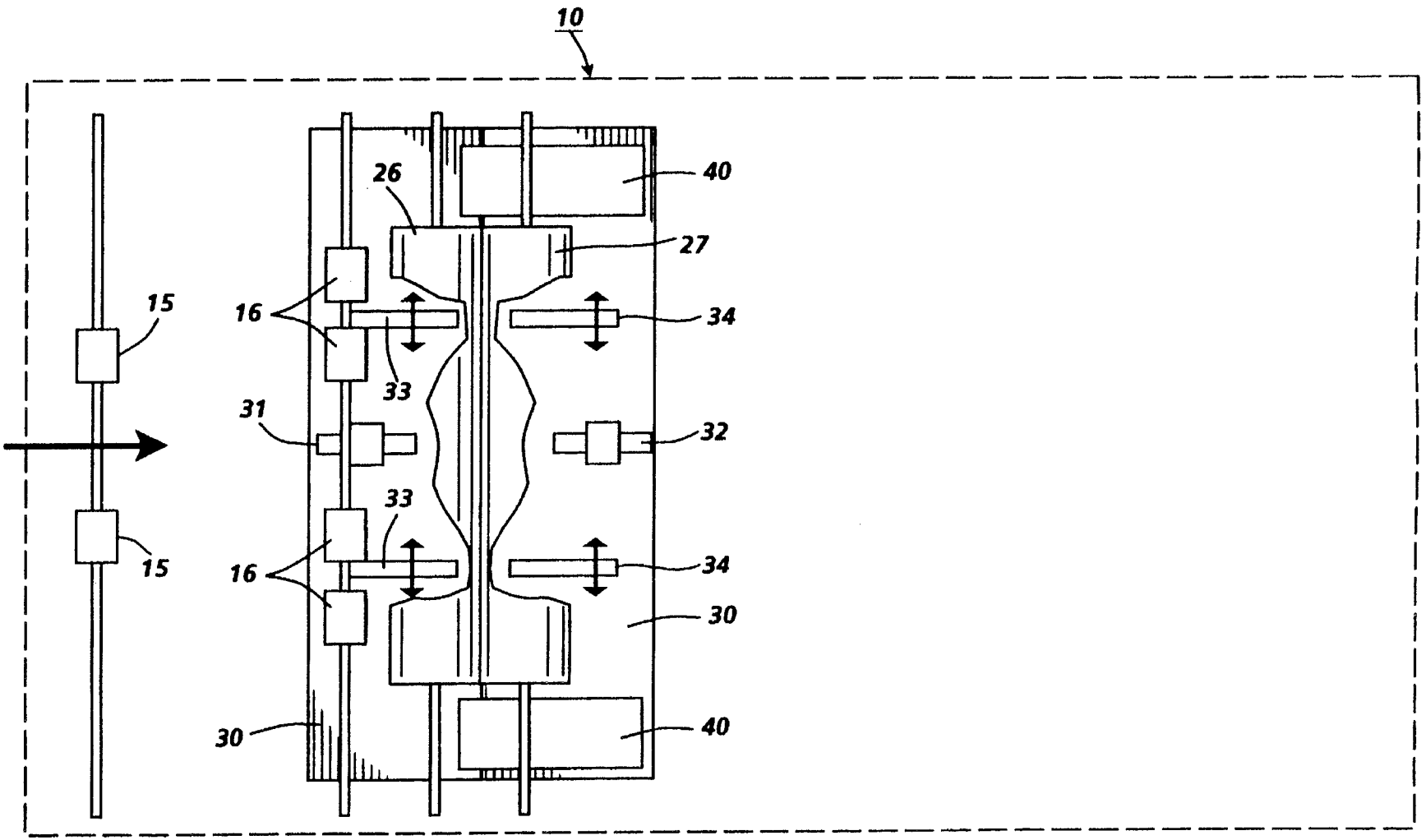
FIG. 3 is a partial schematic top view of the system of FIGS. 1 and 2.

Referring first however to FIGS. 1–3, the signature finisher 10 example here is shown directly adjacent an electronic printer 11 capable of producing and/or outputting printed signature sheets short-edge first. The printer 11 is only shown schematically, since it may be conventional, and thus need not be further described herein. The cited and other art provides examples and alternatives.

There is disclosed in this example 10 a compact, low cost, saddle stitching booklet maker capable of producing tightly folded booklets that lie flat. The system 10 uses a unique fold roll system and compile tray geometry and paper path that enables the individual signature sheets to be individually buckled and fully folded with a sharp crease sequentially as they are outputted by the printer, before compiling, and then readily compiled folded into a set, quire, or other such booklet on a "roof" or "saddle" compiler cooperatively adjacent the fold roll system. This enables each sheet in each booklet to have a tight crease and full fold, for flat-lying professional looking booklets. The illustrated finishing device 10 also includes a set of dual function tampers that compiles the individual sheets on a "roof" or "saddle" compiler, and also move the compiled set into position for stapling. Set ejection from the compiler is provided in this example by an ejecting knife edge or fingers, but into and through the same fold roll system which previously folded the individual sheets thereof, saving space and apparatus.

By way of background, booklets which are made by compiling first, before the sheets are folded together, i.e., folded as a set (whether stapled before or after folding), have a problem. Although the innermost sheets of the set are folded reasonably tightly, the folds in the outer sheets of the set are formed around those inner sheets, and thus around a radius. For this reason, the outer sheets are not folded with a tight crease, and have a tendency to spring back open and/or for the folded end of the booklet to "bulge". Thus, it is preferable to sharply and fully fold each sheet individually before compiling them into sets. However, heretofore this has required relatively large and complex finishing equipment, or delays and/or manual handling of the sheets. Here, the sheets are immediately sequentially folded and compiled automatically, on-line.

As will be further described in the examples herein, fold rolls such as 26, 27 are provided which sequentially fully fold each incoming sheet. Those fold rolls are desirably positioned directly over an "inverted V" or saddle-shaped compiler 30 so that the reversal of the feed rolls (and gravity) can sequentially place each folded sheet directly onto the compiler. After a set has been so compiled, stapling may then be provided while the set is on the same compiler. Here a pair of staplers 40 is schematically illustrated respectively mounted inboard and outboard of the fold rolls, so as not to interfere therewith.

As will be further described, tampers 33, 34 associated with the compiler may be used to slide the compiled set laterally (along the compiler axis) to these inboard and outboard staplers 40 for stapling (or to sequentially step through appropriate stapling positions past a single stapler, if that is desired).

The stapled set ejection system 42 may desirably include a lift mechanism located directly under the compiler to eject the stapled booklet up in to the same fold rolls 26, 27, e.g. 43, 44. The fold rolls feed the set on to an exit transport, for entrance into a trimming station for edge trimming, and then ejection of the completed set into a set stacker.

Figure 14:
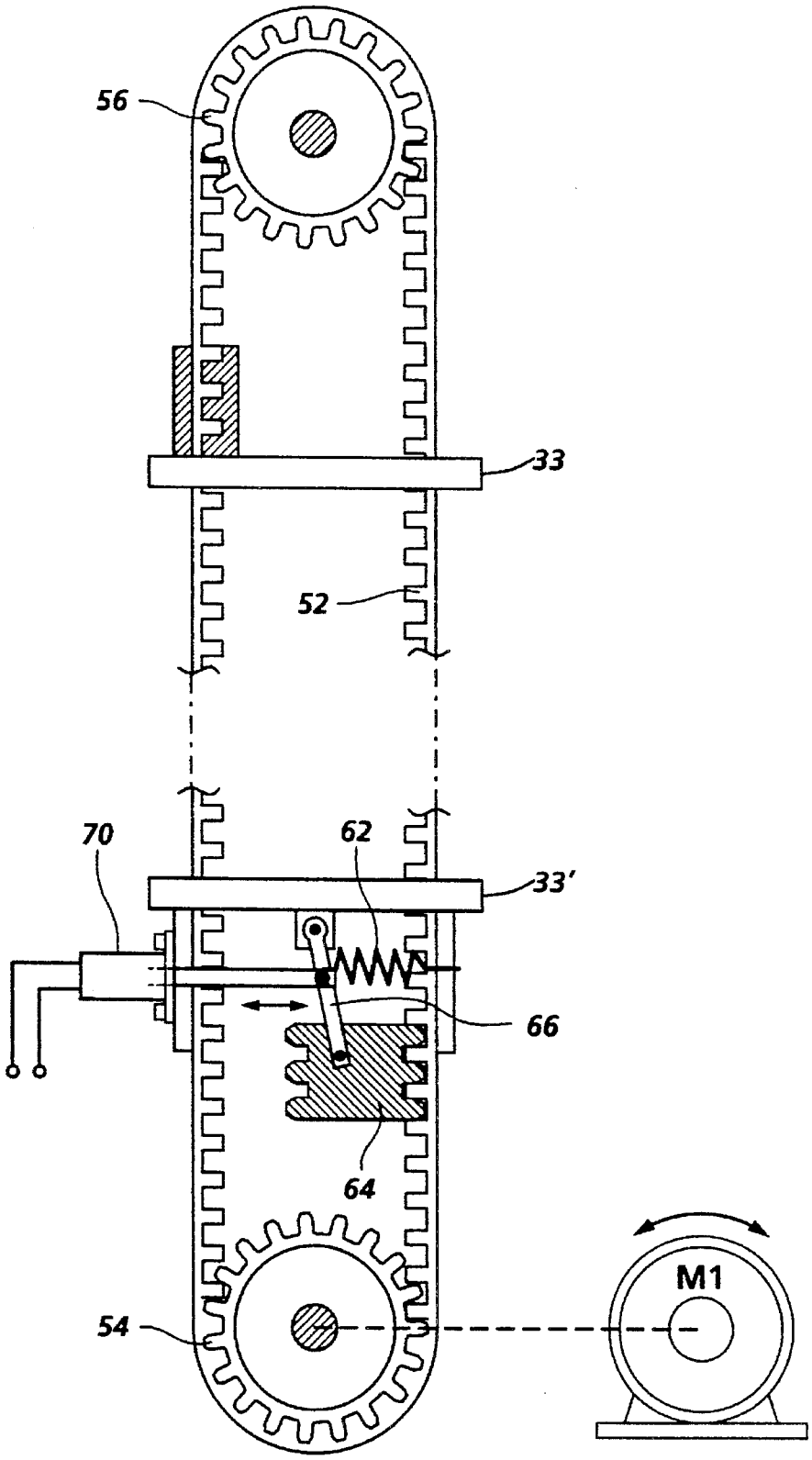
FIG. 14 shows one example of the subject dual mode set tamper drive for both compiling sets and shifting (offsetting) sets, including offsetting for stapling.

FIG. 14 shows an examplary dual mode set tamper drive which can provide both compiling of the sets in evenly aligned stacks in the compiler and also the above-noted shifting of the sets for stapling and/or offset stacking. This is accomplished with only two pairs of tampers on each side of the compiler sheet stacking area. At least one of the tampers of each pair of tampers is provided with dual motions, that is, a motion towards the other tamper for tamping the stack edges during compiling, and then a different, synchronous, motion together to slide the entire set back and forth for stapling (and/or for set ejection). Instead of independent drives for the front and rear tampers, the system disclosed in FIG. 14 enables this dual mode operation with only one drive motor, one drive belt, and a simple clutch changing the engagement of one of the tampers from one side of the drive belt to the other, so as to reverse the motion of that tamper, since the opposite sides or flights of the belt are moving in opposite directions.

FIG. 14 shows here one example of a dual mode tamper drive system and dual mode tamper system. It will be appreciated that this is merely one example of such a dual mode mechanism. It provides normal stack tamping in a first mode, and then selectable positions of stack offsetting of that tamped stack in a second mode, as further discussed herein. One tamper 33 may be permanently fastened, as shown, to a first flight of an endless cogged timing belt 52 running between mounting gears 54 and 56 on opposite sides (ends) of the respective compiler surface 30 (shown in other figures). A frictional belt could be used instead of the cogged belt 52. The other paired tamper 33' is, in the first or tamping mode, temporarily secured by spring 62 to the opposite or second flight of endless timing belt 52 by a gripper, clutch, or belt engagement member 64 pivotable on an arm 66 fastened to tamper 33'. In this first gripper or clutch 64 position, rotation of a tamper drive motor M1 moves tamper 33 towards tamper 33', to provide tamping. Rapid reversals of motor M1's driving direction can provide a rapid tamping action as each sheet enters the compiler to stack. Motor M1 is controlled by the machine's conventional programmed microprocessor controller, as described above. Reversal of motor M1 moves the tampers apart, and that may also be used to set the tamper spacing to the size sheets being tamped.

Arm 66 (or an alternative slide mounting of gripper 64 to tamper 33') is, however, movable by a solenoid 70, actuated by the machine controller, to switch gripper or clutch 64 over into engagement with the first flight of endless timing belt 52. Solenoid 70 is mounted on, and moves with, tamper 33'. In this second mode, tampers 33 and 33' move together in the same direction, to provide set offsetting, by moving the compiled set laterally, as described above, since they are connected to the same side or flight of the belt 52 in this mode. Upon reversal of motor M1 in this mode, the tampers move back together to their original stacking position. The selected amount of rotation of motor M1 in this mode determines the amount of offset. It may be seen that a simple reversal of the drive connection to at least one of the tampers on one side of the stack (the tamper on the side of the stack doing the pushing of stack) is able to shift the stack laterally in the compiler into any desired offset position, for a selected stapling position, as described, and/or for offset stacking downstream of the sets in stacking tray 50.

All of this immediately above described dual mode tamper drive system mechanism can be mounted underneath the compiler tray, except for the tampers 33 and 33' projecting up through a slot in the tray bottom to engage the sheets stacked thereon. This is also true in the case of a normal more horizontal and planer compiler tray (rather than a saddle stitcher compiler like 30), as shown for example in FIGS. 17 and 18.

The systems described here, and many mechanical alternatives thereof which will be apparent from this disclosed function, can provide automatic tamping and automatic offsetting of the stacked set in various compilers before the set is ejected, stapled or unstapled. The set feedout provided by rollers 26, 27 is a non-skewing feedout from the compiler 30, so the set offsetting provided in the compiler may be retained as the offset job set is fed to the output stacking tray 50.

This system or its various alternatives can provide offsetting of the stacked set in the compiler whether the stack is center or side registered. If the compiler is side registered (registered to one edge of the paper path), then, for example, tamper 33' here could be the normally stationary or fixed edge registration wall used in such systems. Tamper 33', which can be, e.g., thin spaced fingers, can be recessed flush with or against such a larger fixed edge registration wall, so that tamper 33' is normally in the same plane as the fixed edge registration wall, for stacking and tamping. Arm 66 and gripper 64 may be centrally positioned out of engagement with either of the two belt 52 flights in the first or tamping mode, so as to allow tamper 33' to remain stationary during compiling in such an edge registration system, with tamping only by opposing tamper 33. Then, for offsetting, the system may then cause engagement of gripper 64 with the belt 52 to provide for movement of tamper 33' and tamper 33 in away from the edge registration position to the selected offset position, as above.

Figure 17:
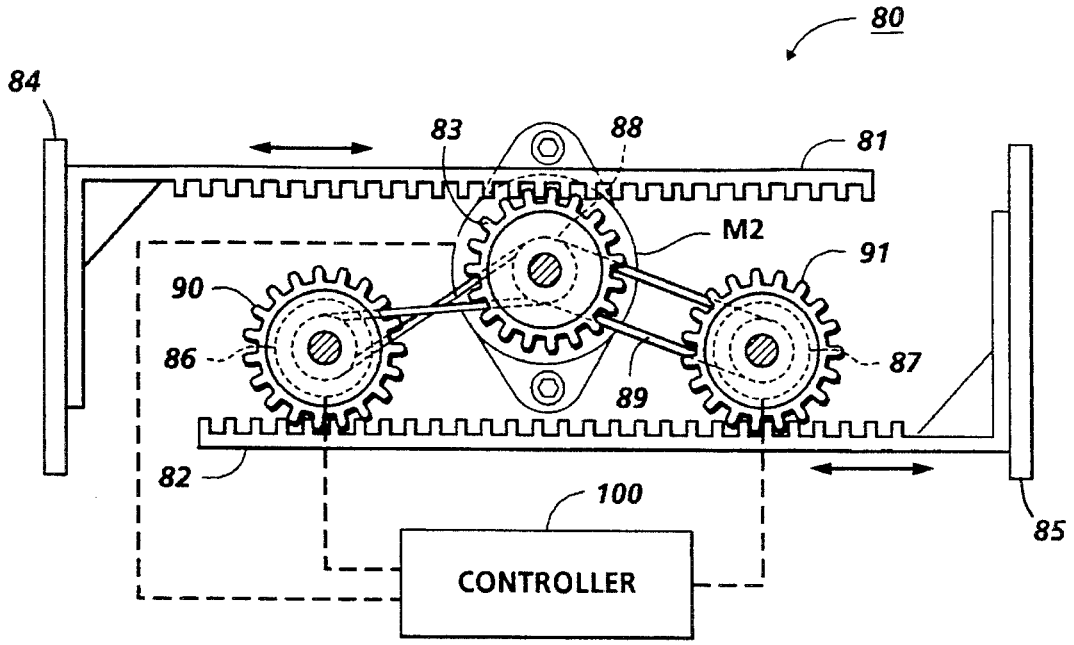
FIG. 17 is a top view of an alternative embodiment of the dual mode tamper/offsetter of FIG. 14, for a conventional compiler (with the overlying tray removed for drawing clarity)
Figure 18:
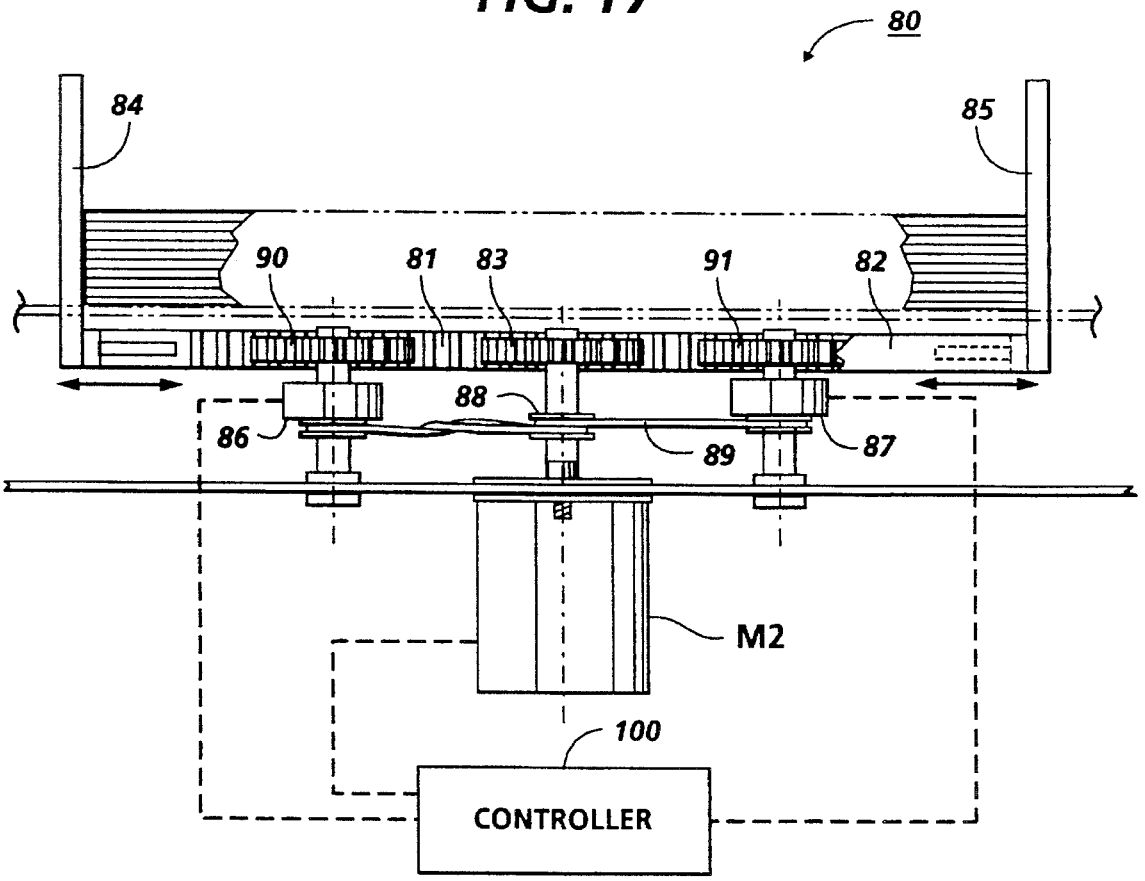
FIG. 18 is a side view of the dual mode tamper/offsetter embodiment of FIG. 17, partially broken away for illustration clarity.

In the alternative embodiment of FIGS. 17 and 18, center registration stacking of all sheets is conventionally provided in a conventional compiler 80 by a modification of a well-known dual rack 81,82 and pinion 83 connection of the side-guides and tampers 84,85 of the compiler 80. The side guides and tampers 84,85 automatically move together to always center the job sheet stack irrespective of their size, by opposite rotation of connected pinions 83 and 90, which moves the geared racks 81,82 on opposite sides thereof in opposite directions. Pinion 83 here is driven by a single motor M2 similarly to M1 described above, and also provides an automatic tamping action, similarly to that described above. For automatic offsetting, a conventional simple electromechanical clutch 86 may clutch motor M2 to drive pinion 90 in the opposite directions from pinion 88, due to its cross-belt drive from motor M2 driving a pulley 88 on M2's shaft. Belt 89, in contrast, rotates in the same direction a pulley rotating pinion 91 via clutch 87 gear-engaging rack 82. This causes racks 81 and 82 to be driven in the same direction as long as clutch 87 is engaged and clutch 86 is disengaged. This allows motor M2 to provide offset driving of side-guides and tampers 84 and 85 in the same direction, without changing the tamper spacing, to provide automatic set offsetting to any desired position in the compiler 80. As described above, while this is described for center registration, for edge registration modifications similar to that described above can be made. The same conventional programmable machine controller 100 shown here may be used for the other machine control functions.

Figure 15:
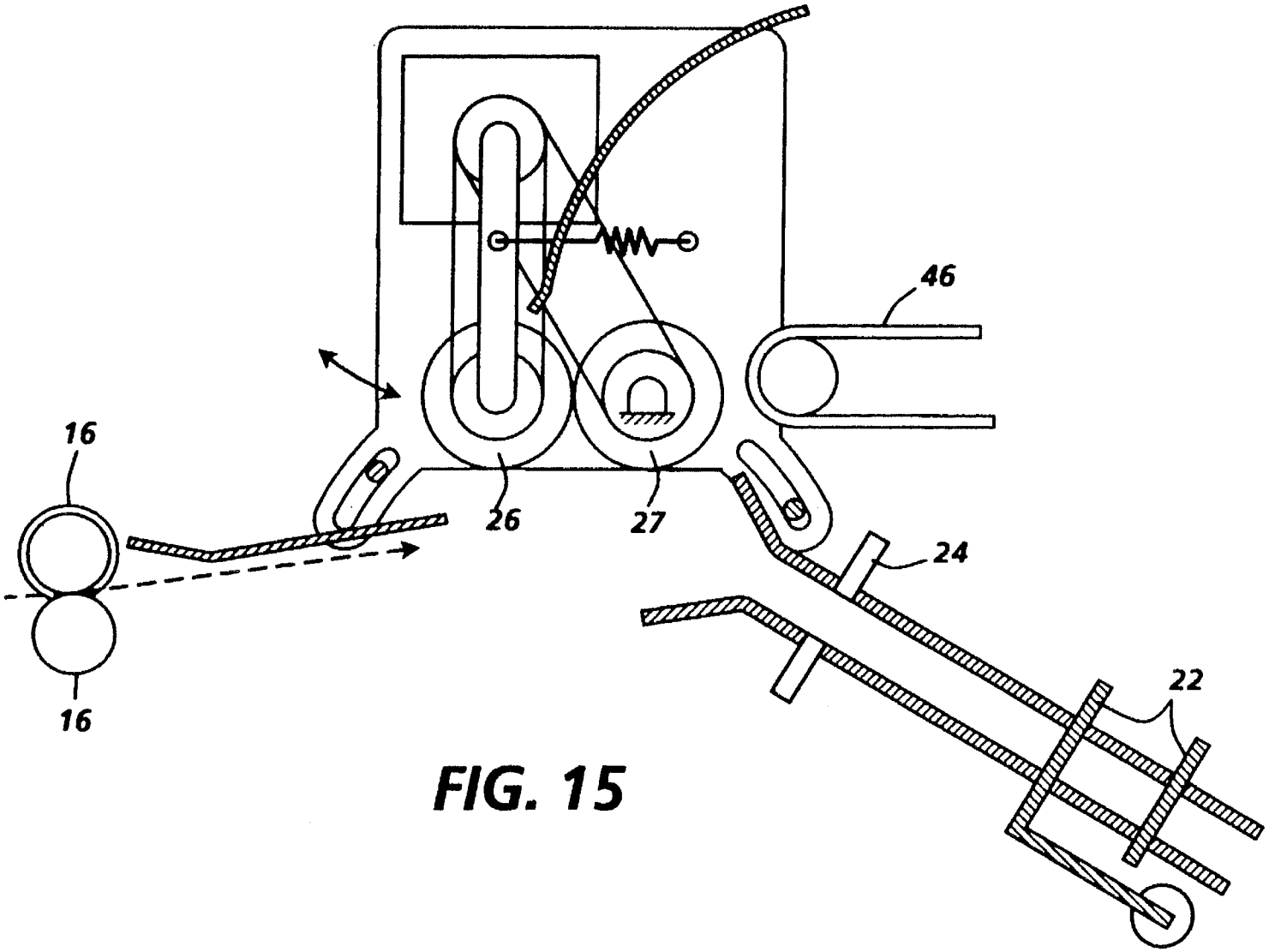
FIG. 15 is an enlarged and more detailed view of one example of an exemplary sheet fold roll variable nip.

As further illustrated in FIG. 15, the fold rolls 26, 27 are spring loaded together to provide a variable nip. One of the rolls may be on a fixed axis and conventionally driven, although a stepper motor or servo motor system drive may be desirable to enable more accurate velocity and positioning control, as well as the drive reversal described below. The other or idler roller defining the fold nip may be pivotally spring mounted so as to enable that idler roll to move relative to the driven roll, so that the roll nip may be spread apart slightly during the folding of a sheet, and then spread apart substantially further for the ejection of the folded set of multiple sheets through the same nip. This other roller may also be rotatably driven, oppositely of course.

It will be appreciated that the roof compiler stapler, set ejector, set exit transport and set edge trimming station examples here can be similar to various of those in existing booklet makers, and thus further details of these subsystems need not be disclosed herein.

Turning now to the operation of the first exemplary signatures device herein, this is sequentially illustrated in FIGS. 4 through 13. Note that in these figures the staplers are not shown, for clarity.

Figure 4:
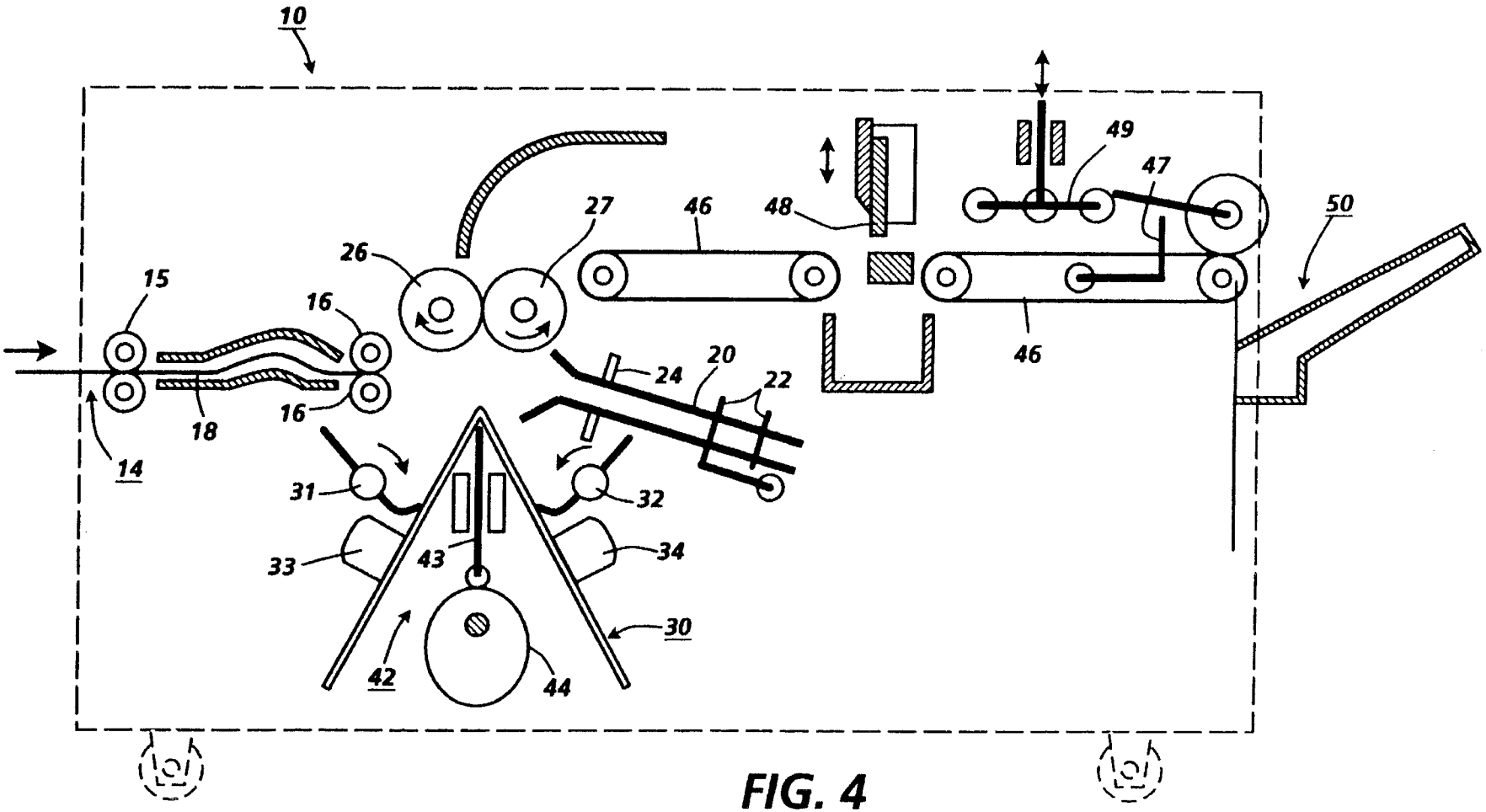
FIGS. 4 to 13 are all identical to FIG. 2, and illustrate successively the operation of the signature system of FIGS. 1–3.

In FIG. 4, the first signature sheet 18 is shown entering from the printer 11 (not shown in these views) from its output 12. The sheet enters the directly adjacent communicating sheet input 14 of the automatic book binding module 10. This sheet input 14 here includes upstream rollers 15 and downstream rollers 16 and an intervening buckle chamber. The rollers 16 are temporarily stalled here in a conventional manner to slightly buckle the sheet for purposes of deskewing the incoming sheet immediately before the entrance to the folder system. However, it will be appreciated that if the sheets are entering the module 10 already sufficiently deskewed or unskewed, that this input system may not be required.

Figure 5:
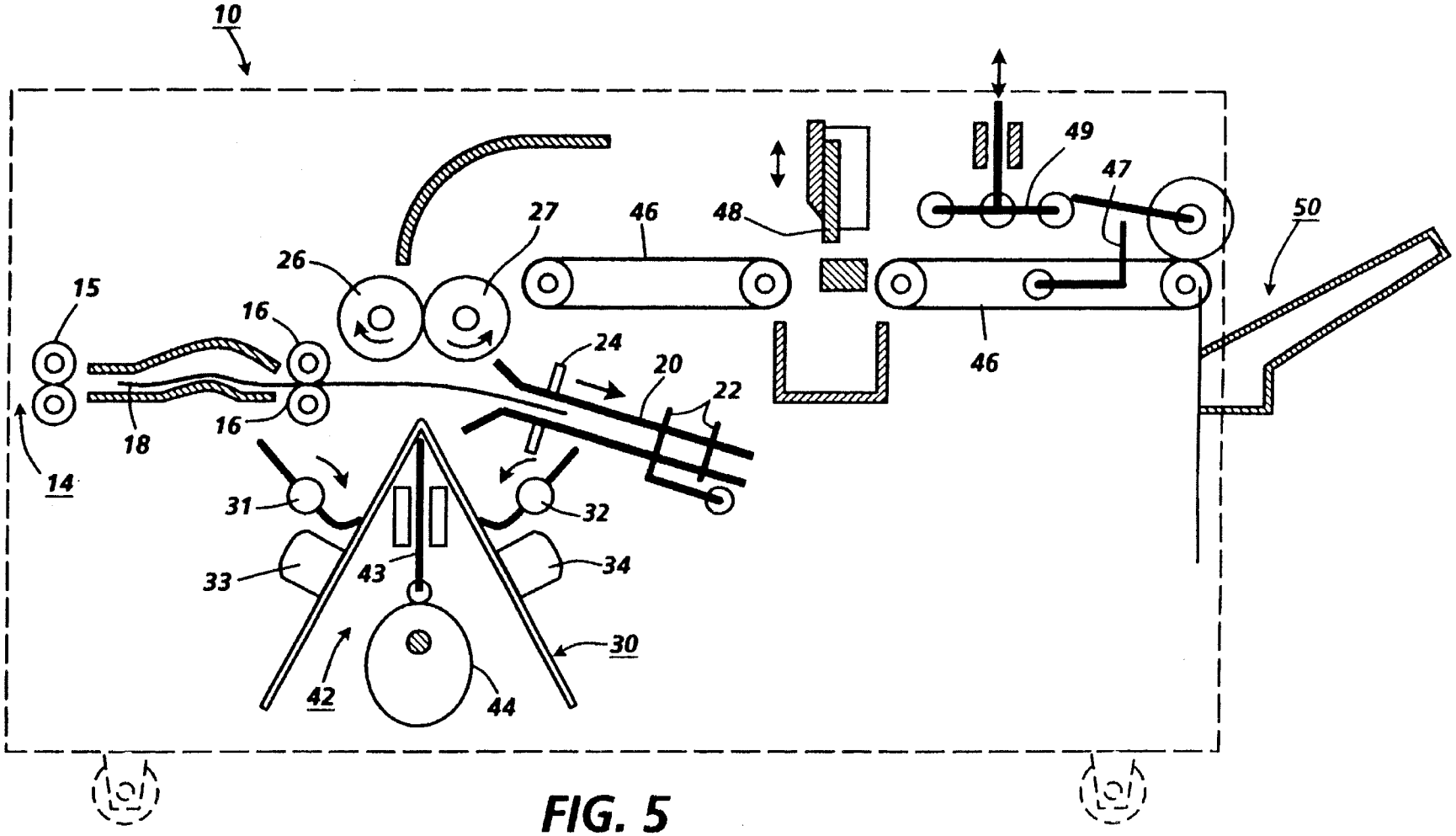

Referring now to the next step shown in FIG. 5, the sheet 18 is now fed out by the deskewing rollers 16 into a fold plate or chute 20 until the lead edge of the sheet 18 reaches a fold plate gate 22 at the desired stopping position of the sheet, which is with the leading area or approximate front half of the sheet 18 in the fold plate 20. The position of the fold plate gate 22 will of course vary or be reset depending upon the size of the signature sheet to be folded and its desired fold line location. (Central sheet folding is shown here.)

Note that as the sheet 18 enters the folder area it passes directly under the nipped pair of fold rolls 26, 27, which, during this sheet entrance movement, are turning in the direction illustrated by the movement arrows thereon, so as to prevent the lead edge of the sheet from stubbing and catching on the right hand fold roll 27. Also note that the sheet 18 is fed in directly over and above the "saddle" or "roof" compiler 30, which is in the shape of an "inverted V" pointing directly towards the nip of the fold rolls 26, 27 with the peak or ridge of the "V" relatively closely adjacent to this nip.

Figure 6:
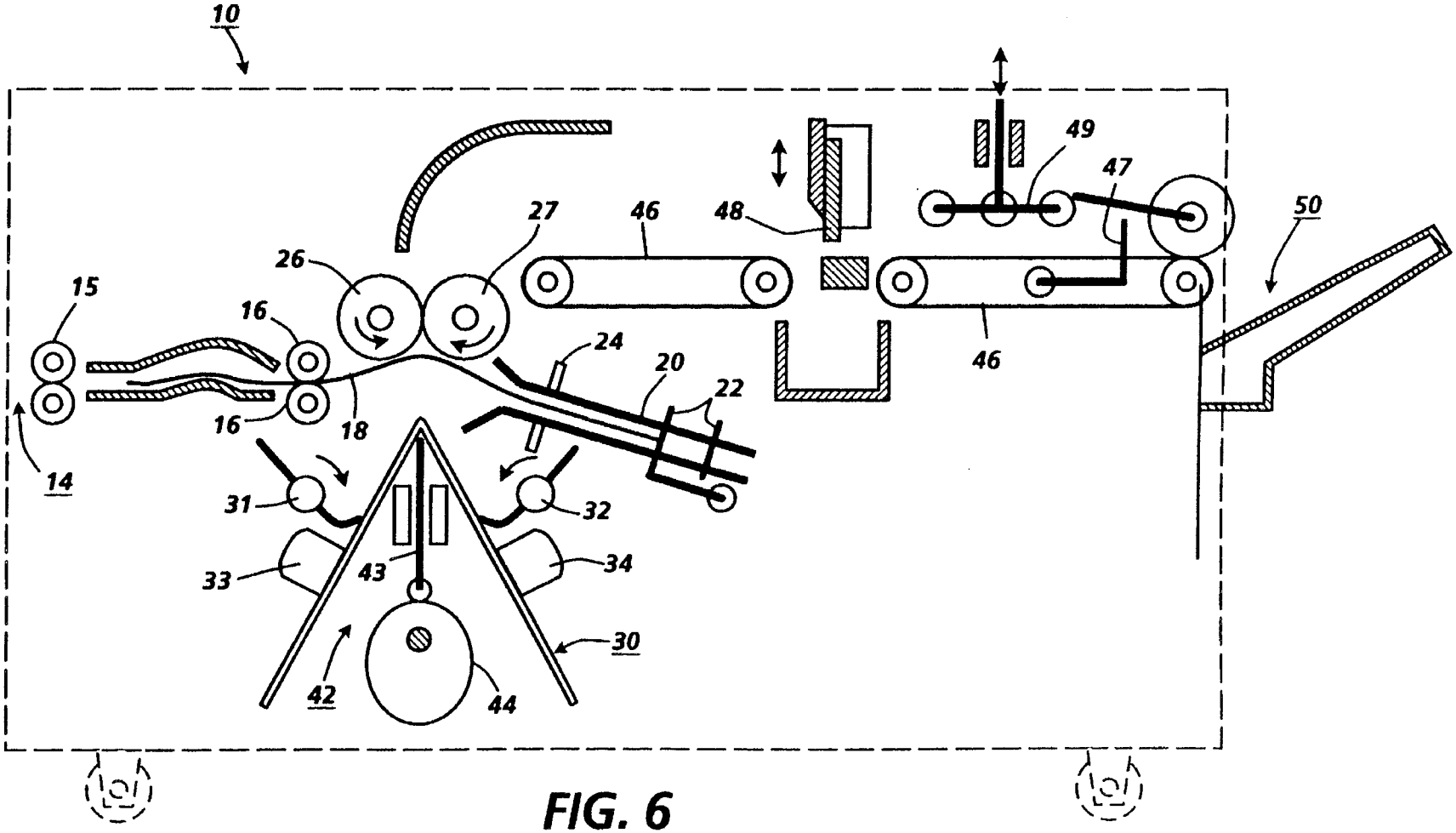

Referring now to FIG. 6, once the lead edge of the entering sheet has passed a fold plate sensor 24, the fold rolls 26, 27 reverse direction, as shown in this figure. As soon as the lead edge of the sheet 18 hits the fold plate gate 22, the central portion of the sheet 18 begins to buckle upwards toward the nip of the feed rolls 26, 27, as shown. This is assisted by the slightly downwardly inclined angle of the fold plate 20 relative to the sheet entrance nip feed rollers 16, which rollers 16 continue to push in the trailing portion of the sheet, to continue to increase the buckling of the sheet, as shown in FIG. 7.

Figure 7:
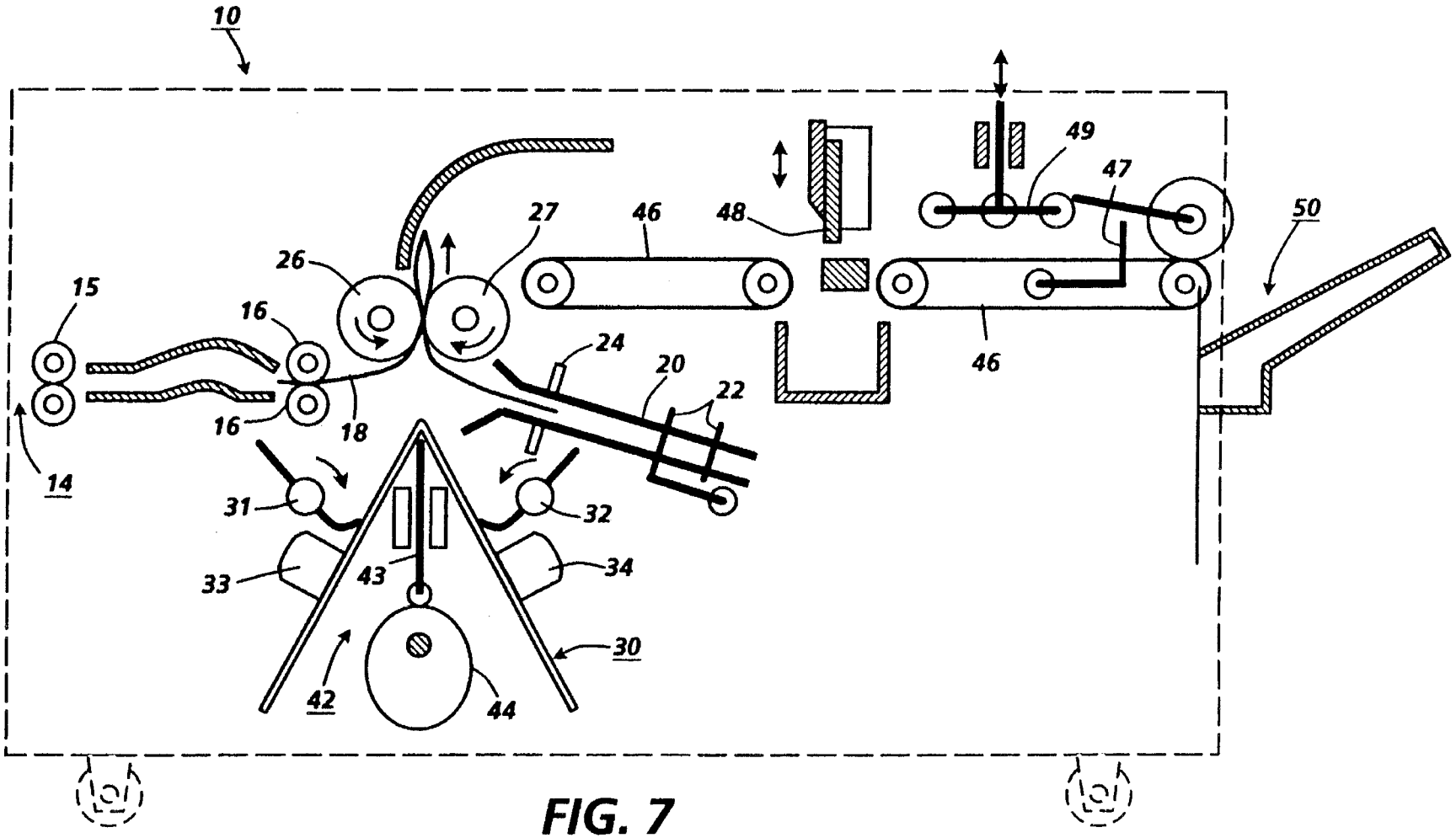

Thus, as shown in FIG. 7, the center of the sheet is buckled up into the nip of the fold rolls 26, 27 and drawn into these fold rolls and fed therethrough to be firmly creased and fully folded together by a substantial nip spring pressure provided between the fold rolls 26 and 27. However, the entire sheet 18 is not drawn all of the way through the fold rolls 26, 27. After the former lead edge (now one of the trailing edges) of the sheet 18 unblocks the fold plate sensor 24, and after that end of the sheet has been pulled out of the fold plate 20 by the fold rolls, the fold rolls 26, 27 are stopped, as shown in FIG. 8.

Figure 8:
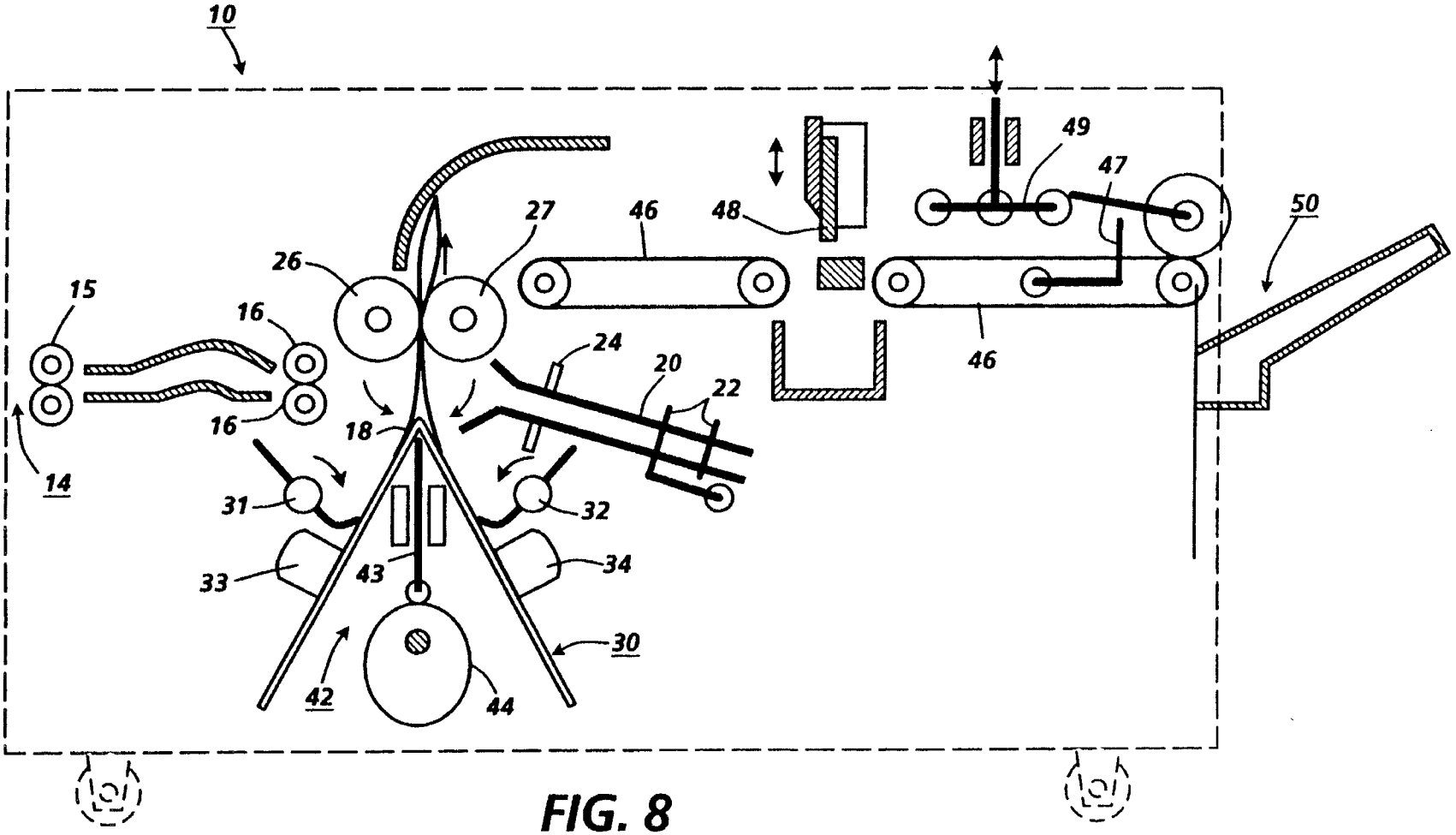

As shown in FIG. 8, the fold rolls 26, 27 stop with the now-folded sheet in a position such that the two trail edges of that sheet are released from the fold plate 20 and also from the entrance nip roller 16. Thus, these sheet ends follow their natural tendency (from both beam strength and gravity) to move towards each other, as shown. However, the distance between the nip of the fold rolls and the upper edge of the compiler 30 is less than the distance between the nip of the fold rolls and the edge of the fold plate. Thus, the two ends of the folded sheet 18 cannot fully close, and are prevented from doing so by the two sides of the compiler 30, which the sheet ends respectively now engage.

Figure 9:
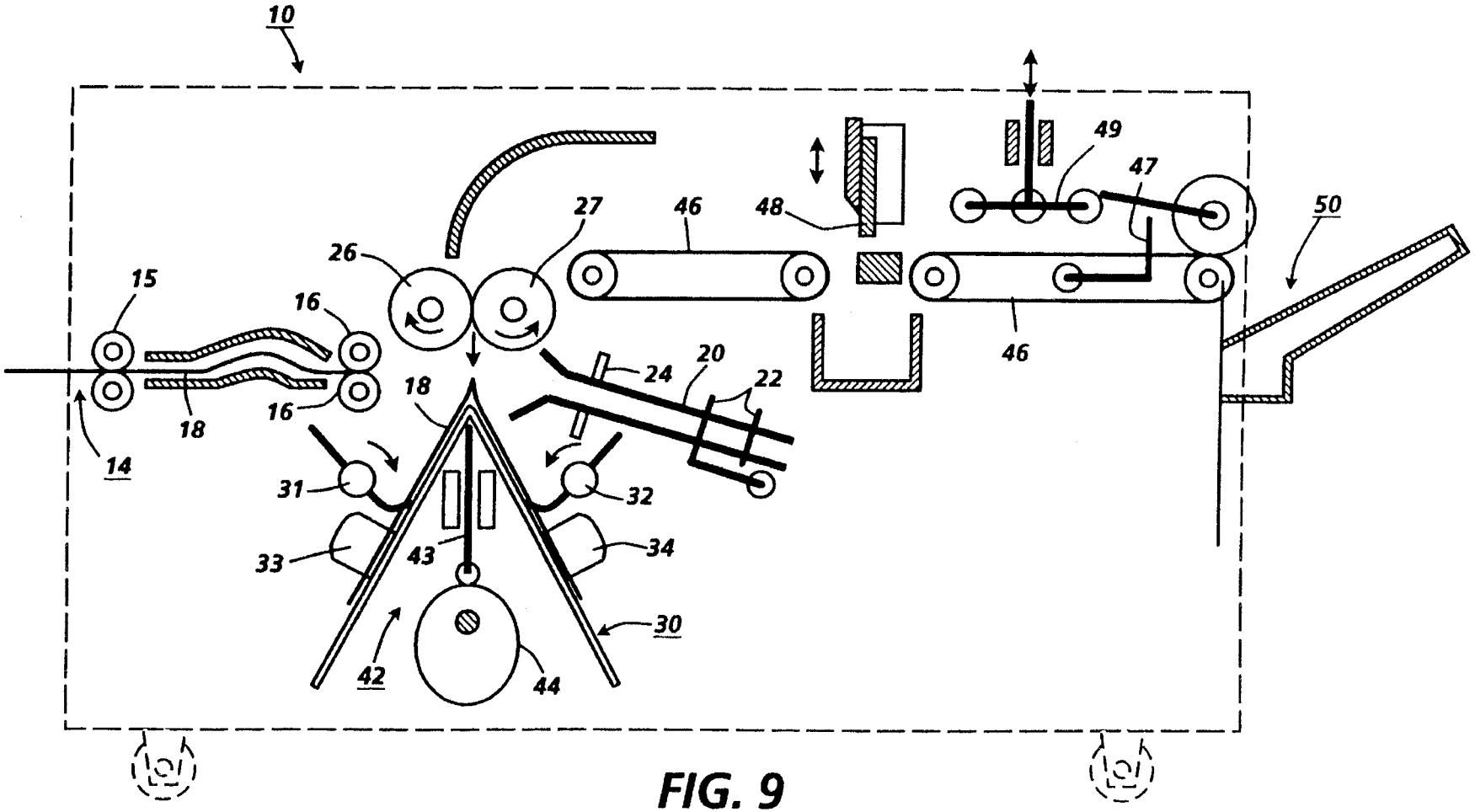
Figure 10:
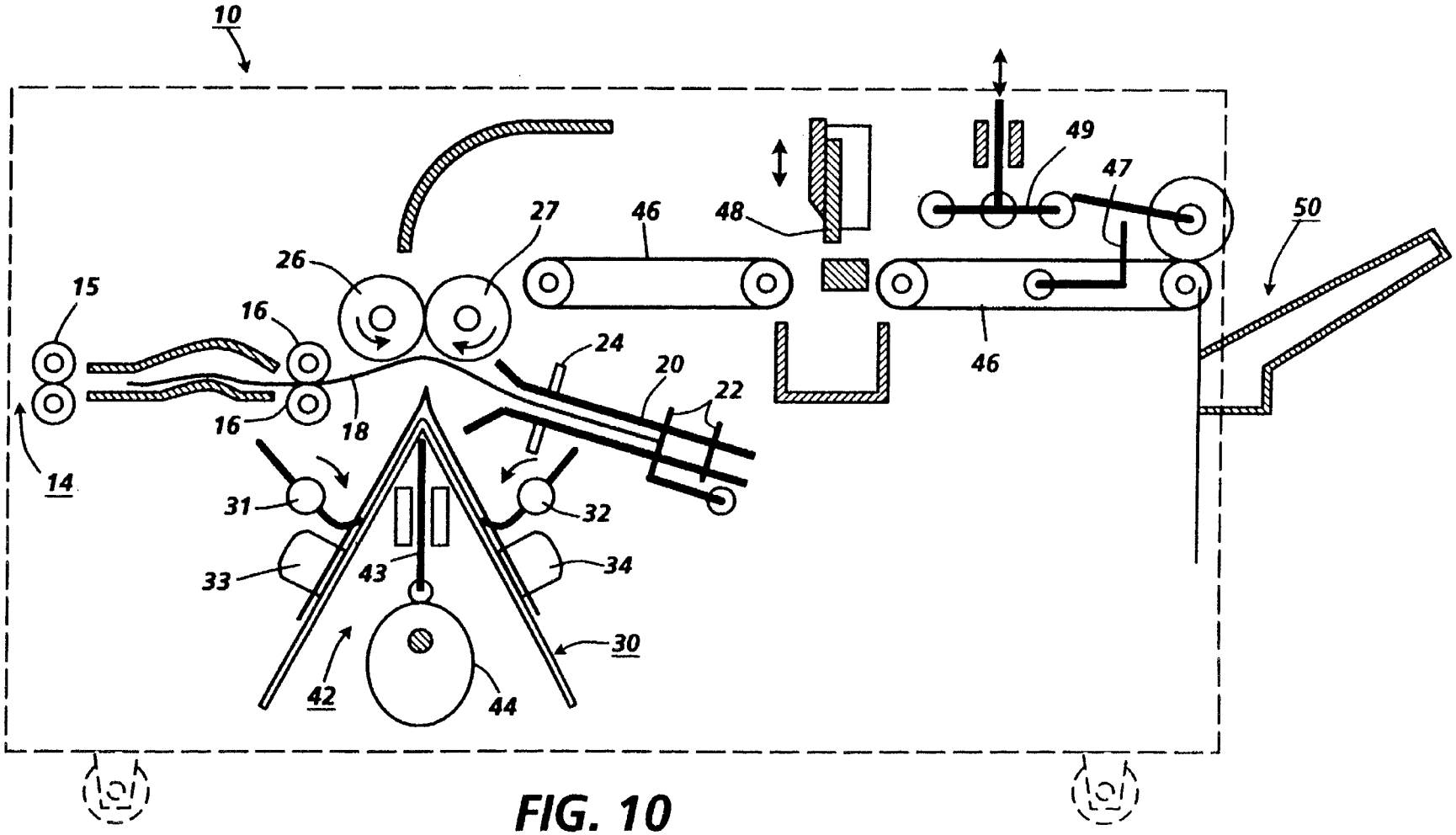

As shown in FIG. 9, the fold rolls 26, 27 are now reversed, and the folded sheet 18, also with the assistance of gravity, is driven down onto the saddle compiler 30. For the final downward movement of the folded sheet 18 onto the compiler 30, after the spline of the folded sheet is released from the nip of the fold rolls, paddle wheels 31, 32 may be provided to respectively engage the two sides of the sheet now riding down on the two sides of the "inverted V" compiler 30 (or onto the previous sheets so stacked thereon, if any). Because the paddle wheels 31, 32 have long flexible blades, they can accommodate the increasing height of the sheets stacked on the compiler and remain in contact with only the outermost or top sheet. [Meanwhile, as shown in FIG. 10, the next incoming sheet is being folded, as described above.]

As described above, pairs of tampers 33, 34 are provided inboard and outboard of the sheets stacked on the compiler 30 for moving the sheets by their lateral edges into a desired registration position. As each further sheet is inputted, folded and placed on the compiler 30 in the same manner as described above, these pairs of tampers 33, 34 move toward each other to align the sheets in a fully aligned stack.

Figure 11:
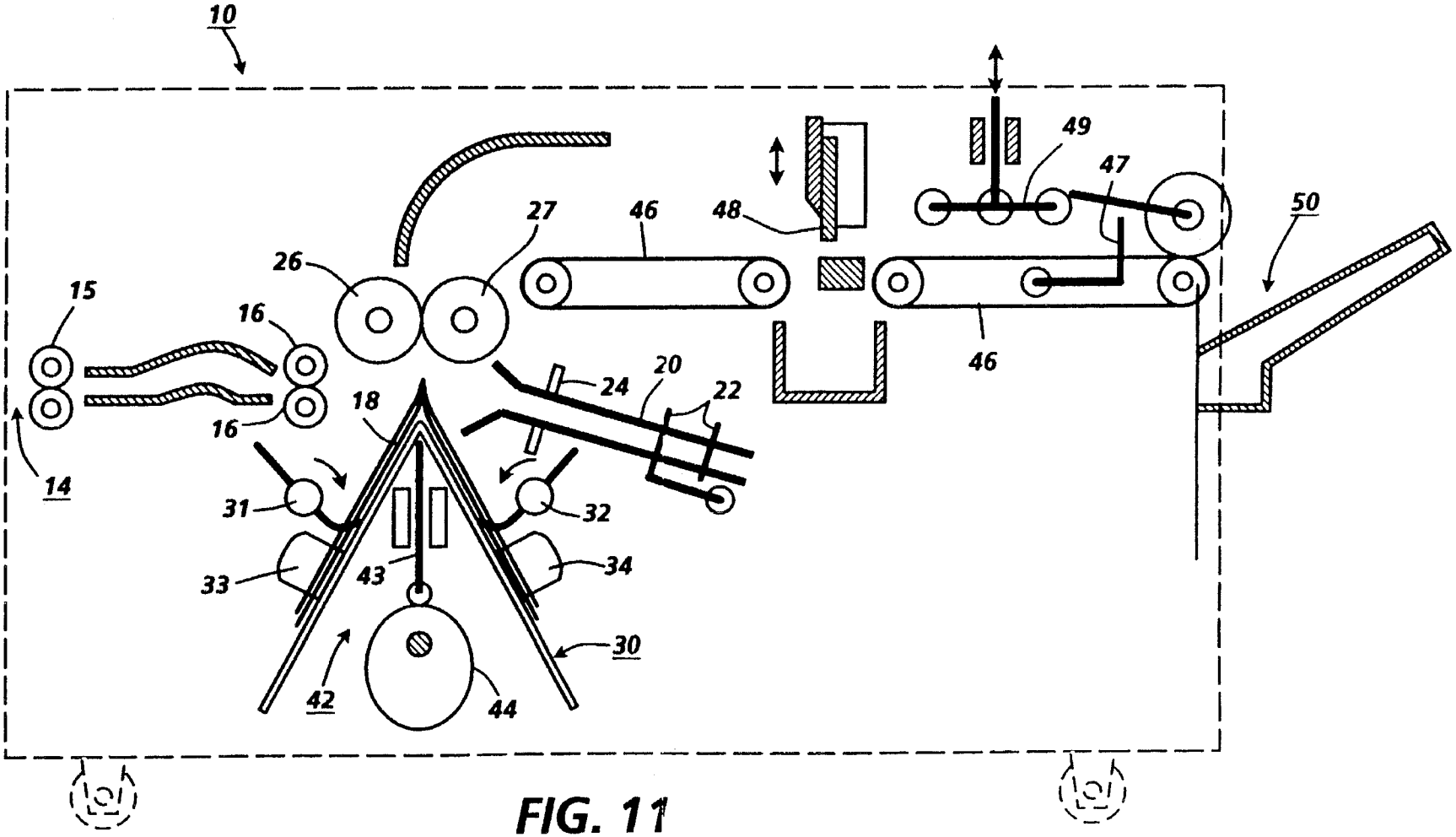

Referring to FIG. 11, after the complete set of collated sheets has been compiled into a booklet of all the printed pages for that booklet, the operation of the tampers 33, 34 may be changed, as described elsewhere herein, and illustrated for example in FIG. 14, to drive the set laterally under the staplers. It will be appreciated that this is not required, but is desirable here for the provision in this example of staplers which are in the front and rear (inboard and outboard) of the fold rollers 26, 27. Thus, the set may be moved outboard frontwardly toward the front stapler, and then rearwardly under the rear stapler, to "saddle stitch" the set in at least two spaced positions along its folded center or spline, conventionally. Alternatively, a single stapler could be used, and the set could be shifted by a greater distance along a longer axis compiler 30, to enable the same stapler to staple the set in at least two locations. Alternatively, one or more staplers could be moved or swung into the folder space to staple the set without moving the set out of its initial compiler position.

Figure 12:
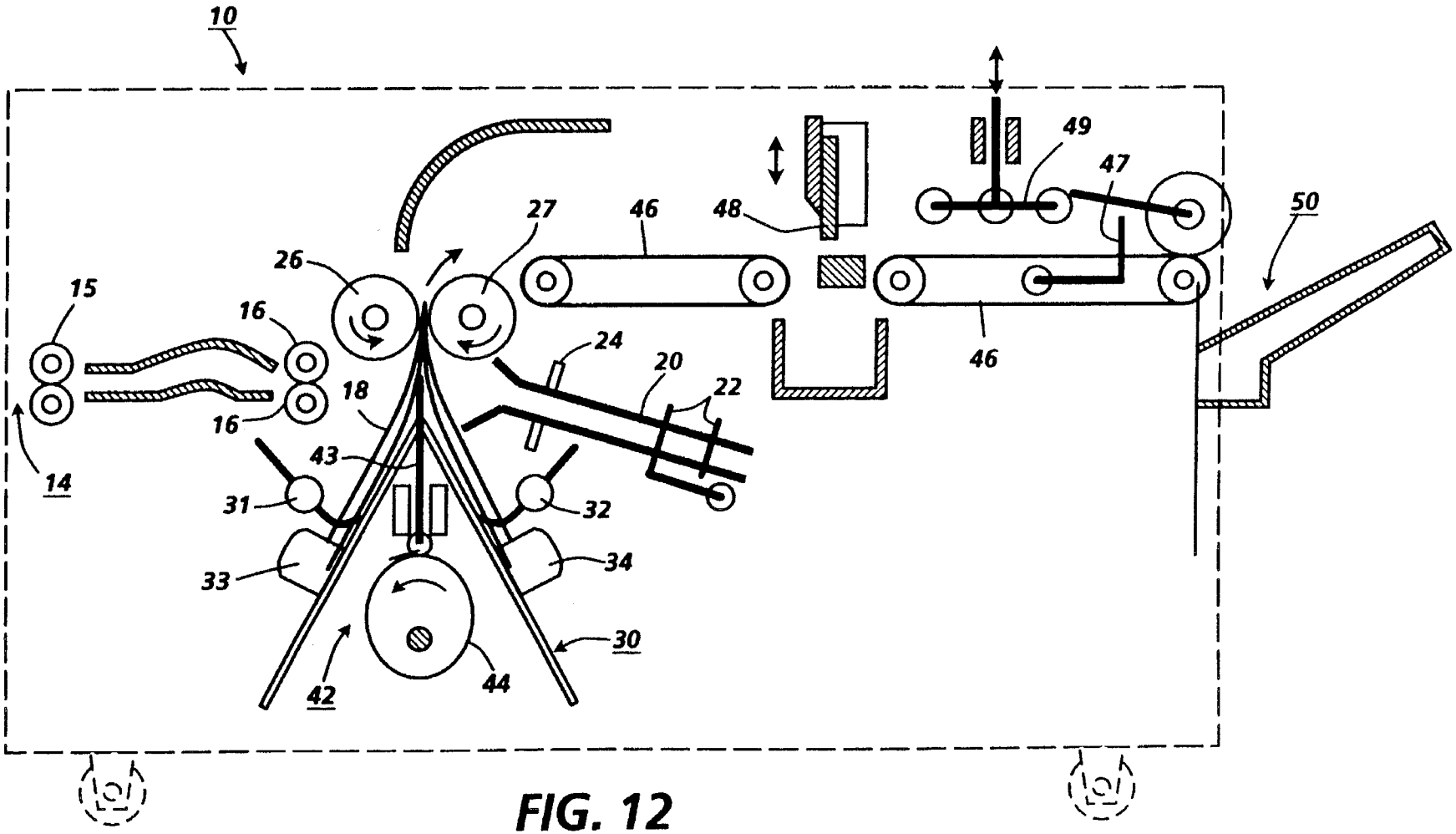

Referring now to FIG. 12, here the set is repositioned in its central or compiling position on the compiler 30 after stapling, so that a set ejection mechanism 42, here comprising a spline knife edge or blades member(s) 43 driven by an eccentric cam 44, may push the set up (from the inside of its spline) into fold rolls 26, 27, which are now rotating in the direction shown here. Spring mounting of these rollers, such as noted herein elsewhere and shown in FIG. 15, allows the nip to open enough to accommodate the full set thickness and positively feed the entire set out through the same nip previously used to individually fold the sheets of that set.

Figure 13:
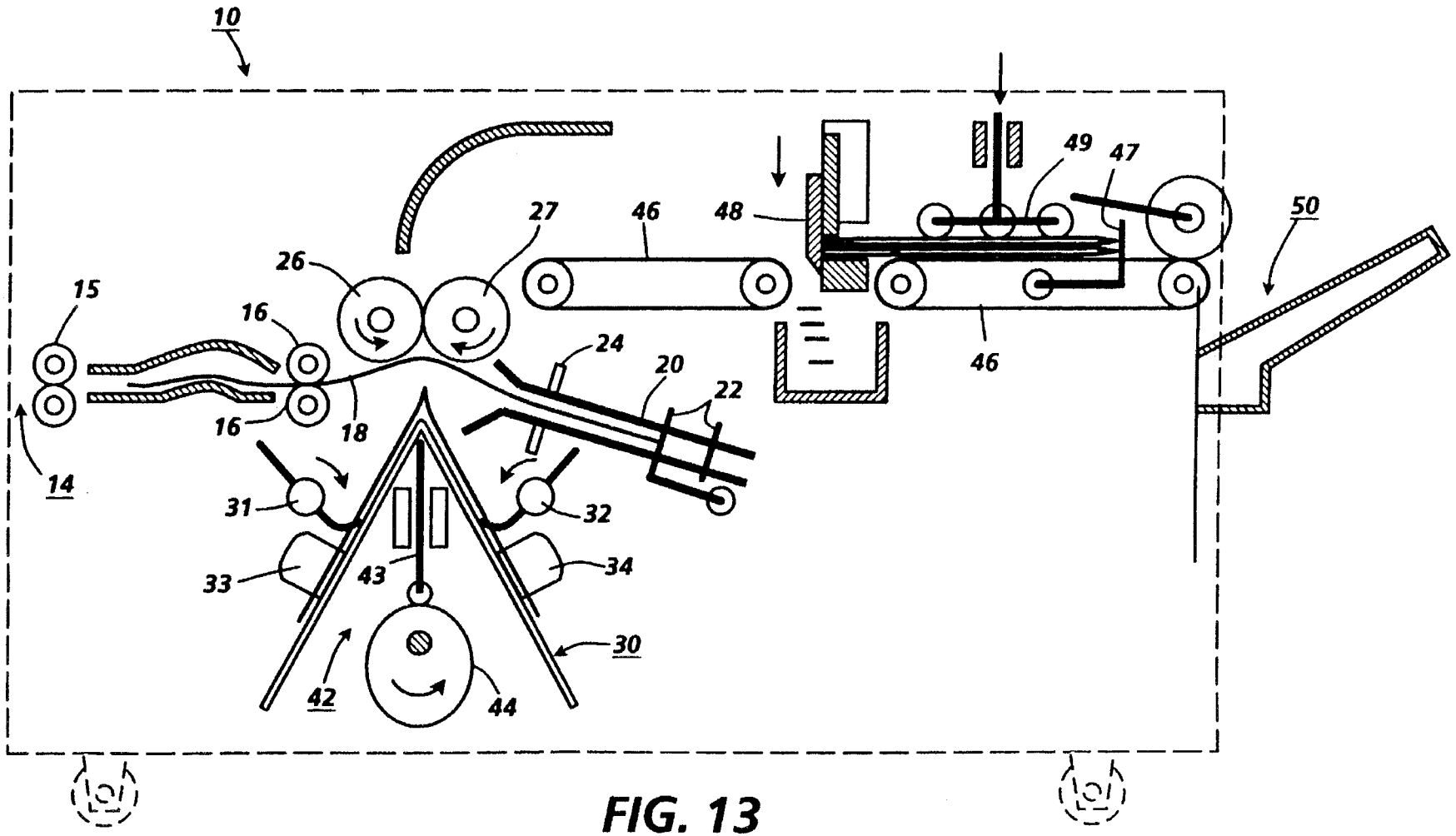

Thus, as shown in FIG. 13, the entire set is now ejected by the fold rolls 26, 27 out onto a set exit transport 46, where it is transported until it is stopped by a set trim gate 47 engaging the downstream or spline end of the stapled booklet. An adjustable position edge trimmer or knife 48 then comes down to trim off the downstream or loose end of the booklet in a conventional manner to provide a commercially desirable completely square or cut end booklet, irrespective of the number of folded sheets in the set. This may be assisted as shown by a set holddown or clamp 49. The trimmed set is now ejected by now opening the set gate 47 and operating the exit transport 46 to further feed the set out from the unit 10 onto a set stacker elevator 50. As shown here, this may be integral of the end of the unit 10. It may move down automatically to accommodate the stacking of a substantial number of finished sets in a known conventional manner. The sets are desirably stacked with the spline or folded and stapled end outwardly, for ease of operator removal, without requiring any inversion of the sets.

Figure 16:
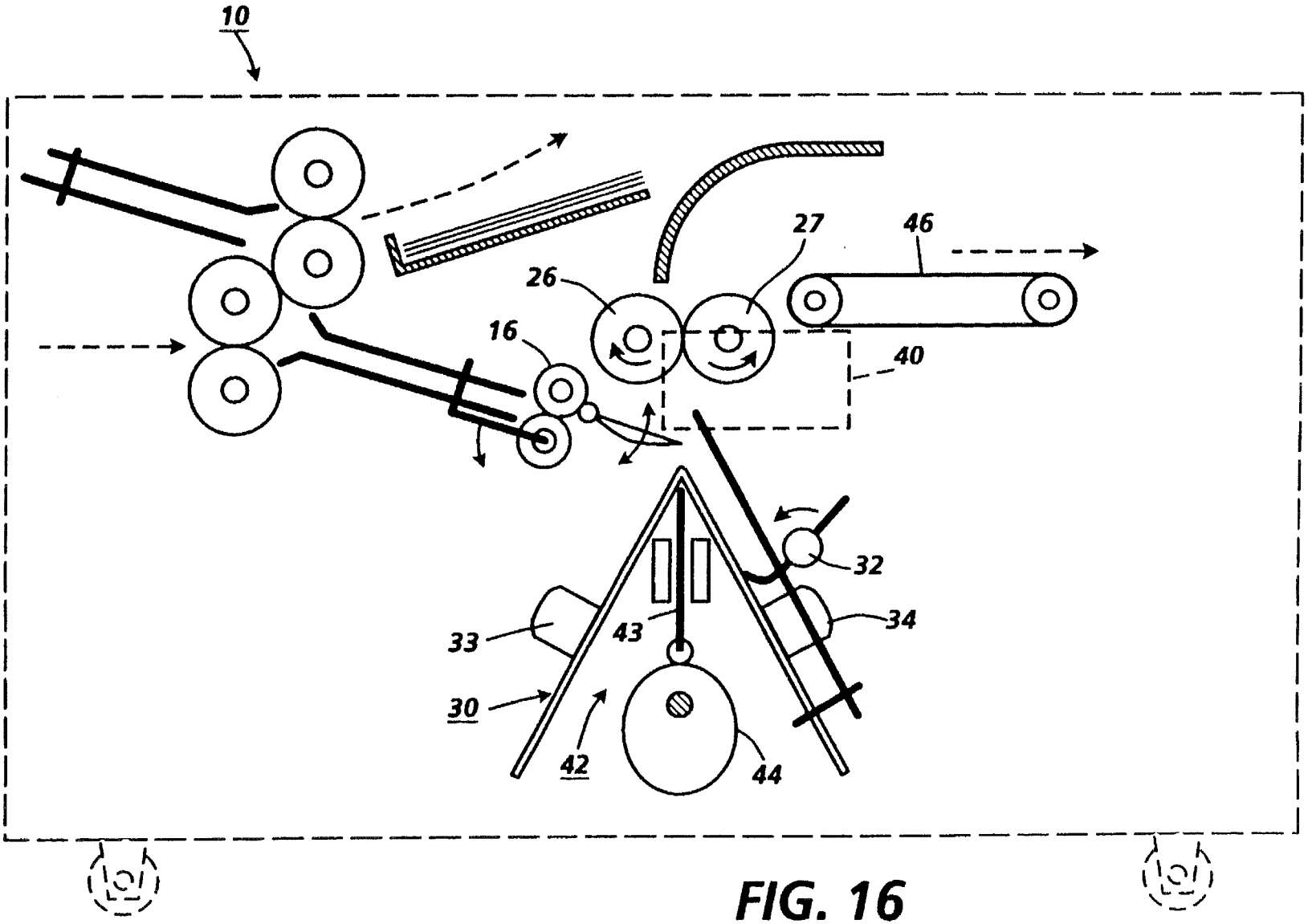
FIG. 16 illustrates an alternative embodiment of a folding architecture.

Referring now to FIG. 16, there is illustrated an alternative embodiment of the folding architecture. This is another example of several possible variations on the architecture shown in the previous figures. For example, by providing additional upstream fold rolls, or moving the fold roll nips further above the saddle compiling station, and providing an upstream fold plate stop therefor, a conventional folding device can be used to perform the prefolding function. This yields a less compact booklet making architecture, but enables the device to also function as a conventional folder for optional letter or "Z" folding, etc. Such a standard buckle folder may have an optional direct exit for folded single sheets upstream of the compiler/stapler unit, as shown in FIG. 16.

As also shown in FIG. 16 another or additional option is for the previously illustrated fold plate 20 system to be located parallel to the right side of the compiler 30. An additional deflector gate can be provided above the left (upstream) side of the compiler, as shown, to deflect down the trailing half of the prefolded sheet down onto the left or trail edge side of the compiler.

In any case, the sheets may be sequentially individually fully centerfolded and then directly placed on the directly adjacent saddle compiler for compiling and stapling, and with positive control over the open ends of the prefolded sheets, so that they do not close before the folded sheet is placed on the compiler.

It will be appreciated from this teaching that various alternatives, modifications, variations or improvements in the disclosed embodiments may be made by those skilled in the art, which are intended to be encompassed by the following claims:

I claim:

1. In a sheet stacking and job separating system for the printed sheet output of print jobs of a reproduction apparatus, in which, repeatedly, plural said printed sheets are compiled as a print job set by being tamped into a squared stack in a compiler with a tamper system, and said compiled print job set stack is ejected from said compiler onto an output stacking tray holding plural said print job set stacks in a common stack, and wherein respective said print job set stacks are stacked offset from one another in said output stacking tray: the improvement comprising a dual mode print job set stack tamper and job sets offsetting system, wherein in a first mode, said tamper system tamps said print job set into a squared stack in said compiler while retaining said print job set in a defined stacking position; and wherein in a second mode said tamper system shifts a selected said print job set out of said defined stacking position into an offset position to provide said offset position of said print job set in said output stacking tray;

wherein said tamper system includes a spaced pair of upstanding sheet tampers between which said printed sheets are compiled, and a dual mode tamper drive system, and wherein in said first mode at least one of said tampers is driven towards the other said tamper to tamp said print job set into a squared stack in said defined stacking position by said dual mode tamper drive system, and wherein in said second mode said dual mode tamper drive system causes said tampers to move cooperatively to shift said print job set out of said defined stacking position into said print job set offset position;

wherein in said second mode said dual mode tamper drive system is connected to both said tampers to move both said tampers in the same direction by a selected print job set offsetting distance;

wherein said dual mode tamper drive system has a single drive motor which is differently connected to said tampers in said first mode than said second mode;

wherein said dual mode tamper drive system comprises a clutching system and a belt drive system directly driven by said single drive motor and connecting with both said tampers by said clutching system, which belt drive system in said first mode is connected by said clutching system to both said tampers at portions of said belt drive system which are moving in opposing directions, and which belt drive system said second mode is connected by said clutching system to both said tampers at respective portions of said belt drive system which are moving in the same direction.

* * * * *